US009930936B2

(12) United States Patent
Liu

(10) Patent No.: US 9,930,936 B2
(45) Date of Patent: Apr. 3, 2018

(54) QUICK RELEASE BUCKLE BELT FOR IMPROVING EFFICIENCY IN SECURITY SCREENING PROCEDURE AND METHOD THEREOF

(71) Applicant: Hsin-Ta Liu, Changhua (TW)

(72) Inventor: Hsin-Ta Liu, Changhua (TW)

( * ) Notice: Subject to any disclaimer, the term of this patent is extended or adjusted under 35 U.S.C. 154(b) by 0 days.

(21) Appl. No.: 14/878,890

(22) Filed: Oct. 8, 2015

(65) Prior Publication Data

US 2016/0021985 A1 Jan. 28, 2016

Related U.S. Application Data

(63) Continuation-in-part of application No. 13/849,350, filed on Mar. 22, 2013, now Pat. No. 9,173,454.

(30) Foreign Application Priority Data

Feb. 7, 2013 (TW) ..... 102104944 A

(51) Int. Cl.

| | |
|---|---|
| ***A44B 11/25*** | (2006.01) |
| ***A44B 11/00*** | (2006.01) |
| ***A41F 9/00*** | (2006.01) |
| *A44B 11/24* | (2006.01) |

(52) U.S. Cl.

CPC ..... *A44B 11/006* (2013.01); *A41F 9/002* (2013.01); *A44B 11/24* (2013.01); *Y10T 24/4065* (2015.01)

(58) Field of Classification Search

CPC ... A44B 11/006; A44B 11/25; A44B 11/2592; A41F 9/002; Y10T 24/3413; Y10T 24/3423

See application file for complete search history.

(56) References Cited

U.S. PATENT DOCUMENTS

| | | | | |
|---|---|---|---|---|
| 1,209,369 | A * | 12/1916 | Wood | A44B 11/2519 24/648 |
| 1,392,237 | A | 9/1921 | Starmer | |
| 1,477,597 | A | 12/1923 | Schneider | |
| 1,737,246 | A | 11/1929 | Jones | |

(Continued)

FOREIGN PATENT DOCUMENTS

| | | |
|---|---|---|
| GB | 2231082 A | 11/1990 |
| TW | 205627 | 5/1993 |

(Continued)

*Primary Examiner* — Jason W San

(74) *Attorney, Agent, or Firm* — Muncy, Geissler, Olds & Lowe, P.C.

(57) ABSTRACT

The present invention relates to a quick release buckle belt, comprising a strap and a buckle. The buckle includes a connecting piece and a buckle body. The connecting piece is firmly secured to one end of the strap, and the connecting piece is substantially made of non-metal materials. One end of the buckle body is configured to fasten or unfasten another end of the strap. Another end of the buckle body is configured to quickly attach to or detach from the connecting piece. The buckle body is made of metal materials unacceptable for metal detectors at security checkpoints. Therefore, a user who wears such belt needs to do before walking through the metal detectors is to remove the buckle body, without taking off the strap and the non-metallic connecting piece which is acceptable for the metal detector at security checkpoint.

2 Claims, 5 Drawing Sheets

(56) References Cited

U.S. PATENT DOCUMENTS 2,067,484 A 1/1937 Freysinger
2,629,104 A 2/1953 Easlick
2,630,612 A 3/1953 Stark
2,806,275 A 9/1957 Stoll
2,807,849 A 10/1957 Legat
2,865,074 A 12/1958 Meeker
3,017,641 A 1/1962 Stollman
3,201,840 A * 8/1965 Jantzen ..... A44B 11/2519 24/634
3,308,516 A 3/1967 Mullan
3,562,766 A 2/1971 Dye
3,605,210 A * 9/1971 Lohr ..... A44B 11/2511 24/635
3,665,565 A 5/1972 Kruger
3,713,192 A * 1/1973 Wallin ..... A44B 11/2511 24/634
3,789,467 A * 2/1974 Aratani ..... A42B 3/08 24/313
4,161,806 A * 7/1979 Hennisse ..... A41F 1/006 24/586.11
4,217,681 A * 8/1980 Grohoski ..... A44C 5/14 224/164
4,281,440 A 8/1981 Britz
4,406,043 A * 9/1983 Friedman ..... A44B 11/006 24/171
4,419,792 A * 12/1983 Kohli ..... A44B 11/24 24/170
4,458,390 A 7/1984 Fogelson
4,539,736 A * 9/1985 Yokosuka ..... A44B 11/25 24/265 WS
5,309,610 A 5/1994 le Gal
5,341,544 A 8/1994 Richter et al.
5,440,792 A 8/1995 Ida
5,561,891 A * 10/1996 Hsieh ..... A44B 11/14 24/170
5,673,463 A 10/1997 Chih-wen
5,735,024 A * 4/1998 Ortiz ..... A44B 11/266 24/573.11
5,875,523 A 3/1999 Chen
6,108,821 A 8/2000 Malsoute
6,145,169 A 11/2000 Terzuola et al.
6,389,653 B1 * 5/2002 Matoba ..... A44B 11/006 24/265 AL
6,484,372 B2 * 11/2002 Novak ..... A44B 11/2592 24/312
6,571,434 B2 6/2003 Ortiz
6,606,770 B1 8/2003 Badrenas Buscart
6,668,434 B2 * 12/2003 Casebolt ..... A44B 11/253 24/265 BC
6,687,964 B2 * 2/2004 Vanderpool ..... A44B 11/26 24/265 BC
7,114,225 B2 10/2006 Casebolt et al.
7,350,277 B1 * 4/2008 Canfield ..... A44B 11/253 24/634
7,373,701 B2 * 5/2008 Coulombe ..... A44B 11/253 24/171
7,480,967 B2 * 1/2009 Kojoori ..... A44B 11/006 2/322
7,712,192 B2 5/2010 Lin et al.
7,743,473 B2 6/2010 Lin et al.
7,849,566 B2 * 12/2010 Yamamoto ..... A44C 5/2052 24/265 WS
7,946,103 B2 5/2011 So et al.
8,065,781 B2 11/2011 Chao
8,176,605 B2 5/2012 Mok
8,181,319 B2 5/2012 Johnson et al.
8,365,364 B2 2/2013 Labelson et al.
8,464,407 B2 * 6/2013 Von Der Ahe ..... A44B 11/2519 24/634
8,572,820 B2 * 11/2013 Richards ..... A44B 11/2519 24/634
9,521,882 B2 * 12/2016 Hung ..... A44B 11/2511
9,730,495 B2 * 8/2017 Howell ..... A44B 11/266
2002/0002761 A1 * 1/2002 Novak ..... A44B 11/2592 24/312
2002/0184742 A1 * 12/2002 Casebolt ..... A44B 11/253 24/634
2003/0182777 A1 10/2003 Kim
2006/0218761 A1 10/2006 Anscher
2006/0288546 A1 12/2006 Wu
2008/0041126 A1 2/2008 Yu
2008/0168634 A1 7/2008 Chen et al.
2009/0013510 A1 * 1/2009 Liang ..... A44B 11/266 24/648
2010/0205789 A1 * 8/2010 Labelson ..... A44B 11/006 24/458
2013/0192033 A1 * 8/2013 Hortnagl ..... A44B 11/2519 24/633
2014/0215766 A1 * 8/2014 Liu ..... A44B 11/006 24/188
2014/0215773 A1 * 8/2014 Hortnagl ..... A44B 11/2519 24/633
2014/0298630 A1 * 10/2014 Hortnagl ..... A44B 11/2592 24/697.2
2015/0305449 A1 * 10/2015 Kranzlein ..... A44B 11/006 2/322

FOREIGN PATENT DOCUMENTS

TW M311291 5/2007
WO WO 2014082108 A1 * 6/2014 ..... A44B 11/006

* cited by examiner

QUICK RELEASE BUCKLE BELT FOR IMPROVING EFFICIENCY IN SECURITY SCREENING PROCEDURE AND METHOD THEREOF

BACKGROUND OF INVENTION

1. Field of Invention

The invention relates to a waist belt or a leather belt for decorative purpose of clothing (commonly called as belt hereinafter), and more especially to a belt that is allowed for a walk-through metal detector at airport security checkpoint for improving efficiency in security screening procedure.

2. Related Prior Art

A belt supporting trousers or other articles of clothing commonly consists of an elongated strap and a metal buckle. The buckle typically includes a connecting piece secured to one end of the strap and a buckle body itself. The buckle body is designed to receive another end of the strap passing through, which allows the strap to be fixed therein or be loosened.

At present, it is well known that all airports are equipped with walk-through metal detectors under airport security screening rules, where all passengers are asked to walk through the metal detectors for screening illegal items that aren't allowed, such as knives. The buckle of the traditional belt as mentioned previously is securely fastened to one end of the strap, which is meant to be non-removable. Also, the buckle is typically made of metal materials. Thus, it is certainly understood that passengers who wear this type of belts are requested to take off the whole belt, including the buckle and the strap, when walking through the metal detector for security screening, which incurs inconveniency. Accordingly, such traditional belts are not optimized in practical uses.

SUMMARY OF INVENTION

The present invention is directed to a belt with quick release buckle for improving efficiency in an airport security screening procedure, and more specifically, the metallic portion of the buckle can be quickly release from the strap, which indicates that there is no need for user to remove the whole belt before walking through metal detectors at security checkpoints, thereby improving efficiency in an airport security screening procedure.

Specifically, the present invention relates to a quick release buckle belt, which comprises a strap and a buckle. The strap includes a first end and a second end opposite to each other. The buckle includes a connecting piece and a buckle body. The connecting piece is firmly secured to the first end of the strap, and the connecting piece substantially has a material of non-metal that is acceptable for a metal detector at a security checkpoint. One end of the buckle body is configured to selectively fasten or unfasten the second end of the strap, and another end of the buckle body is configured to quickly attach to or detach from the connecting piece. Besides, the buckle body has a material of metal that is unacceptable for the metal detector at the security checkpoint. As such, the only thing the user who wears the belt needs to do before walking through the metal detector is to remove the buckle body, without taking off the strap and the non-metallic connecting piece around user's waist which is acceptable for the metal detector at security checkpoint.

Preferably, the buckle further includes an elastic fastener and an engaging recess in mating engagement with the elastic fastener, which allows the buckle body to be quickly attached to or quickly detached from the connecting piece. The elastic fastener is disposed at a side of the buckle body, and the engaging recess is defined in a side of the connecting piece that is in opposite to the side of the buckle body. The elastic fastener is designed to be engaged within the engaging recess or to be released from the engaging recess.

Preferably, the buckle further includes a guiding block and a limiting slot in mating engagement with the guiding block. The guiding block and the limiting slot are respectively disposed in either the buckle body or the connecting piece. The guiding block is inserted into the limiting slot when the buckle body is attached to the connecting piece.

Preferably, the buckle further includes a dovetail groove and a dovetail joint in mating engagement with the dovetail groove, which allows the buckle body to be quickly attached to or quickly detached from the connecting piece. The dovetail groove and the dovetail joint are respectively disposed in either the buckle body or the connecting piece.

The present invention is further directed to a method of improving efficiency in an airport security screening procedure for a user who wears a belt, which comprises the following steps. First of all, an aforementioned quick release buckle belt is provided, wherein the quick release buckle belt comprises an identification mark thereon. Then, the user is informed that for those who wears such quick release buckle belt, the only thing he/she needs to remove before walking through the metal detector is the buckle body, without taking off the strap and the connecting piece around user's waist which is acceptable for the metal detector at security checkpoint. In another way, the security personnel is informed as well that the identification mark represents that the connecting piece substantially has a material of non-metal which is acceptable for the a metal detector. And, the user wears such quick release buckle belt having identification mark thereon. The security personnel identify the identification mark on the belt, and thus allow the user wearing the strap and the connecting piece secured thereto to walk through the metal detector. Finally, the user just needs to remove the buckle body and then to walk through the metal detector with the strap and the connecting piece wearing around his/her waist under permissions of security personnel.

Nevertheless, the quick release buckle belt of the present invention is a belt including a quickly release buckle, which is quite convenient for a user to remove quickly before walking through the metal detectors at security checkpoints, thereby improving efficiency in an airport security screening procedure.

Other features, objects, aspects and advantages will be identified and described in detail below.

DETAILED DESCRIPTION OF EMBODIMENTS

FIG. 1 to FIG. 5 are perspective drawings showing a quick release buckle belt 100 for improving efficiency in an airport security screening procedure in accordance with a first embodiment of the present invention. The quick release buckle belt 100 essentially comprises a strap 1 and a buckle 2.

Figure 1:
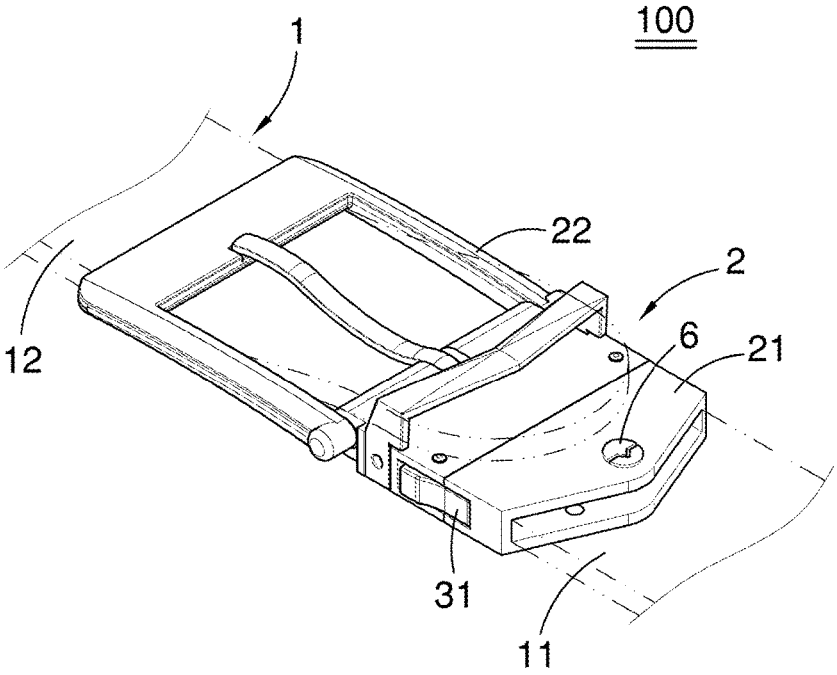
FIG. 1 is a stereo perspective drawing showing a quick release buckle belt for improving efficiency in an airport security screening procedure in accordance with a first embodiment of the present invention.
Figure 2:
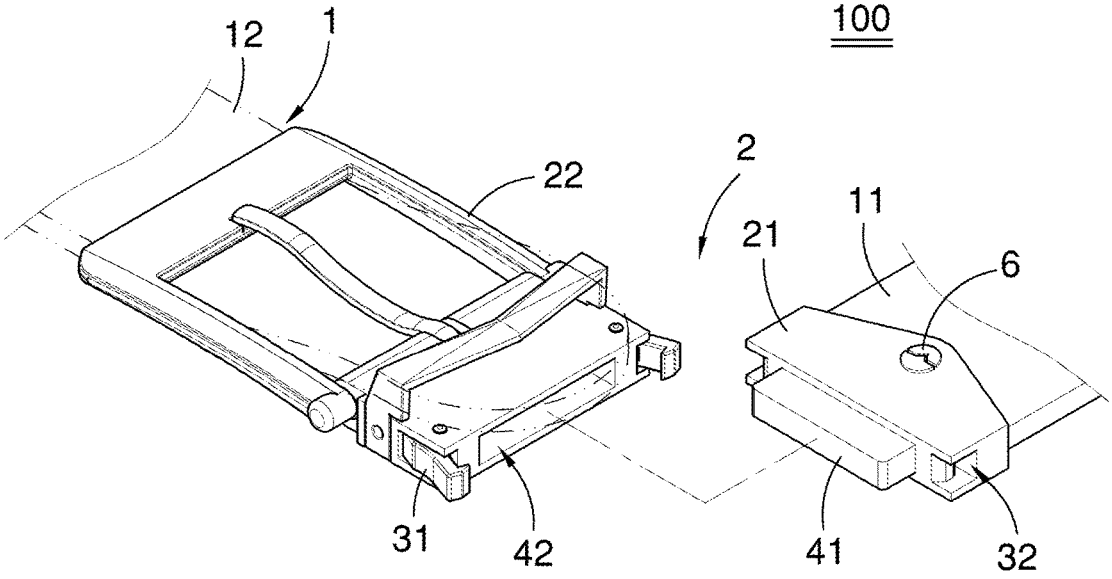
FIG. 2 is an exploded view of the quick release buckle belt in FIG. 1.
Figure 3:
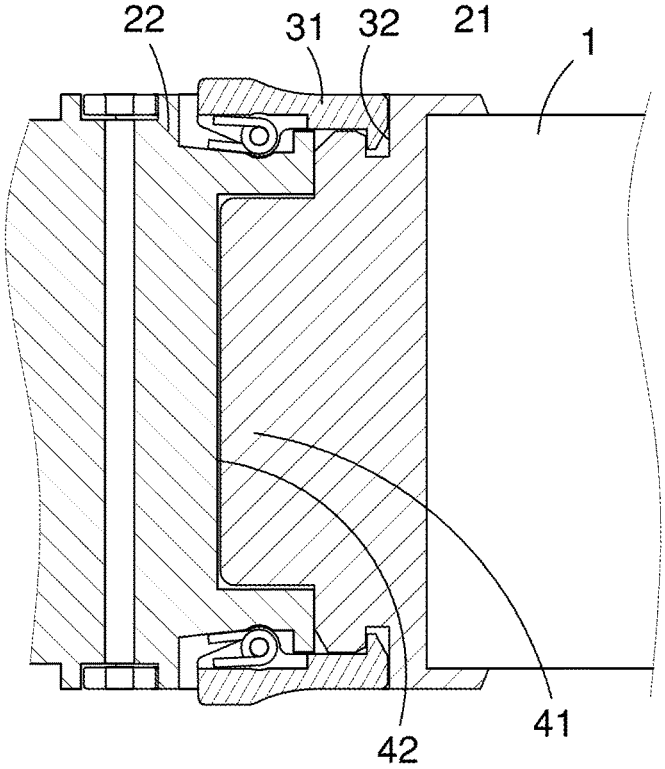
FIG. 3 is a cross-sectional view of the quick release buckle belt in FIG. 1, which shows the belt is in an engagement state.
Figure 4:
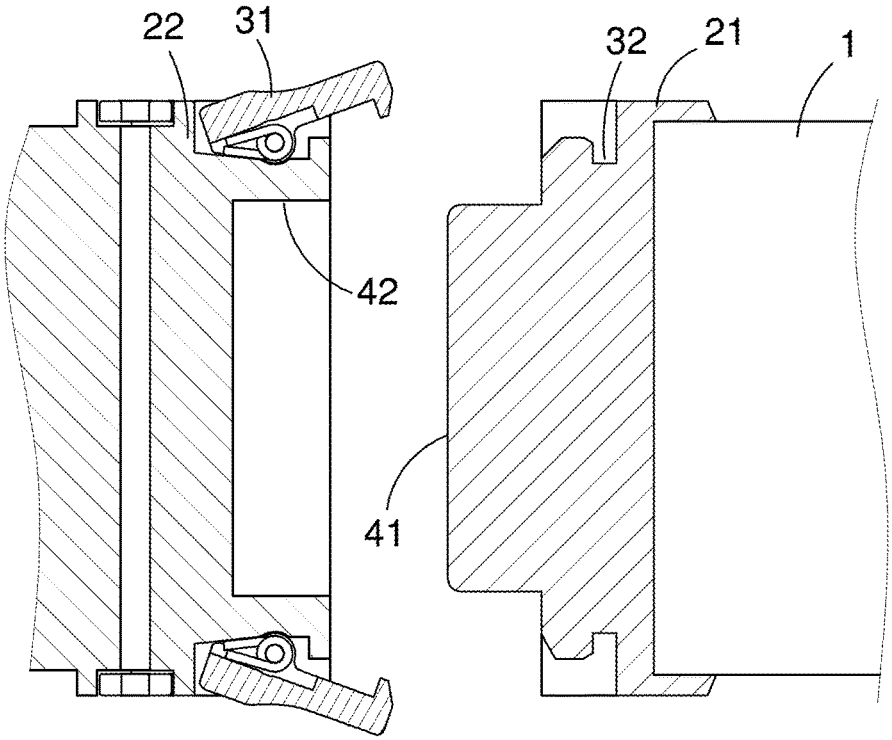
FIG. 4 is similar to FIG. 3, which shows the belt is in a release state.
Figure 5:
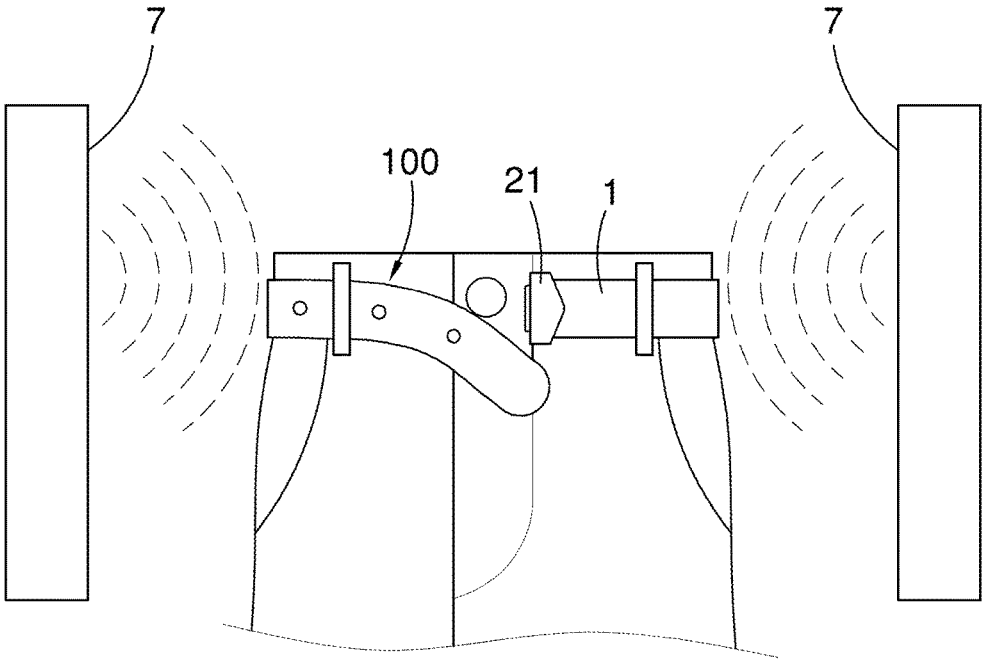
FIG. 5 is a perspective view showing that a user just wears the strap and the connecting piece secured thereto around user's waist.

With reference to FIG. 1 and FIG. 2, the strap 1 includes a first end 11 and a second end 12 that are opposite to each other. The buckle 2 includes a connecting piece 21 and a buckle body 22. The connecting piece 21 is firmly secured to the first end 11 of the strap 1. Correspondingly, one end of the buckle body 22 is applied to fasten or unfasten the second end 12 of the strap 1, and another end of the buckle body 22 is designed to quick-detachably assemble to the connecting piece 21 as shown in FIG. 3 and FIG. 4. More specifically, the connecting piece 21 is substantially made of non-metallic materials, for example, polyethylene (PE) in application of artificial joint, glass-reinforced plastics (GRP) or Acrylonitrile Butadiene Styrene (ABS), which offer abrasion resistance, tensile strength and breaking resistance. The buckle body 22 is made of metallic materials that can be detected by a walk-through metal detector at an airport security checkpoint. Therefore, all the passenger, who wears such quick release buckle belt, needs to do before walking through the metal detector is to remove the metallic buckle body 22, without taking off the strap 1 and the non-metallic connecting piece 21 around the waist as shown in FIG. 5. It thus appears that the strap 1 and the connecting piece 21 secured thereto around the passenger's waist are perfectly acceptable for the sensors 7 of the metal detector at the security checkpoint, which shows that the passenger wearing such belt can walk through the metal detector (assuming no other metallic accessories are worn thereon). Preferably, the quick release buckle belt 100 further comprises an identification mark 6 on the connecting piece 21 (or on the buckle body 22) for consumers or the security personnel to identify. In other words, the identification mark 6 represents that the connecting piece 21 of the quick release buckle belt 100 is substantially made of non-metallic materials, which is a permitted item that is allowed to pass through the metal detector. As such, it is convenient for consumers or the security personnel to identify such quick release buckle belt 100, which is distinct from other traditional belts.

It must be said that detection sensitivity of the metal detector can be adjusted according to the demands, which allows items containing a slight amount of metallic materials (such as metal dentures, buttons or the like) to pass through. Correspondingly, the connecting piece 21 is substantially made of non-metallic materials, which may contain a slight amount of metallic materials (such as baking metallic lacquer or the like) as long as the amount is below the alarm threshold for security detection.

In the first embodiment, the buckle 2 of the quick release buckle belt 100 further includes an elastic fastener 31 and an engaging recess 32 in mating engagement with the elastic fastener 31, which are disposed at two sides thereof, as shown in FIG. 2. The elastic fastener 31 is preferably made of metallic materials and disposed at a side of the buckle body 22 that is made of metallic materials as well. The engaging recess 32 is defined in a side of the connecting piece 21 that is made of plastic materials. The side of the buckle body 22 mentioned above is in opposite to the side of the connecting piece 21.

Therefore, the elastic fastener 31 is designed to be engaged within the engaging recess 32 (as shown in FIG. 3) or to be released from the engaging recess (as shown in FIG. 4), which enables the connecting piece 21 to be quickly attached to or quickly detached from the buckle body 22. In this embodiment, the buckle 2 is designed as a buckle with two-side fasteners, which indicates that there are two sets of the mating engagements, i.e. two sets of the elastic fastener 31 and the engaging recess 32, respectively disposed at two opposite sides of the buckle 2, but not limited thereto. The buckle 2 can be also designed as a buckle with one-side fastener as well, which shows that there is only one set of the mating engagement of the elastic fastener 31 and the engaging recess 32, disposed at one side thereof.

Besides, with reference to FIG. 2, the buckle 2 further comprises a guiding block 41 and a limiting slot 42 in mating engagement with the guiding block 41. The guiding block 41 and the limiting slot 42 are disposed in transverse arrangement of the buckle 2, which prevents from transversely detaching when the buckle body 22 is securely attached to the connecting piece 21, as shown in FIG. 3. The guiding block 41 and the limiting slot 42 are respectively disposed at the buckle body 22 and the connecting piece 21. Alternatively, the guiding block 41 and the limiting slot 42 are respectively disposed at the connecting piece 21 and the buckle body 22. The guiding block 41 is inserted into the limiting slot 42 when the buckle body 22 is attached to the connecting piece 21. In this embodiment, the guiding block 41 is disposed at a central area of a end face 210 of the connecting piece 21, and the limiting slot 42 is defined in a central area of a end face 220 the buckle body 22. As shown in FIG. 2, the engaging recess 32 includes a front opening 321 defined in the end face 210 of the connecting piece 21, and a side opening 322 defined in the side of the connecting piece 21 and adjacent to the front opening 321. Moreover, as shown in FIG. 4, the engaging recess 32 further includes an alcove 323 with an opening facing the side opening 322 of the engaging recess 32, and a guiding slope 324 facing the front opening 321 of the engaging recess 32. As shown in FIGS. 3 and 4, the elastic fastener 31 has a first end 311 pivotally connected to the side of the buckle body 22, and a second opposite end 312 configured to move with the first end 311 so as to engage in or withdraw out of the engaging recess 32 in the connecting piece 21. While the elastic fastener 31 is snapped into the engaging recess 32 in the connecting piece 21, the second opposite end 312 of the elastic fastener 31 will be pushed outward by the guiding slope 324 of the engaging recess 32 and then be released back to engage in the alcove 323 of the engaging recess 32. In particular, the engaging recess 32 is configured in shape and size to receive the second opposite end 312 of the elastic fastener 31 in a manner that when the second opposite end 312 of the elastic fastener 31 is engaged in the alcove 323 of the engaging recess 32, the second opposite end 312 of the elastic fastener 31 is flush with the side of the connecting piece 21, as depicted in FIG. 3.

Figure 6:
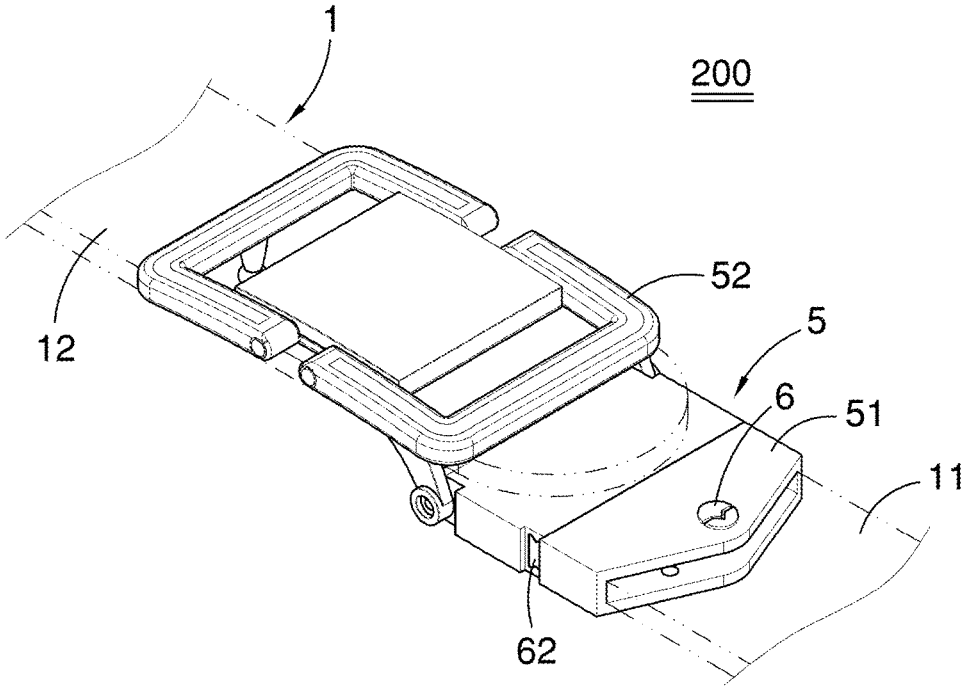
FIG. 6 is a stereo perspective drawing showing a quick release buckle belt for improving efficiency in an airport security screening procedure in accordance with a second embodiment of the present invention.
Figure 7:
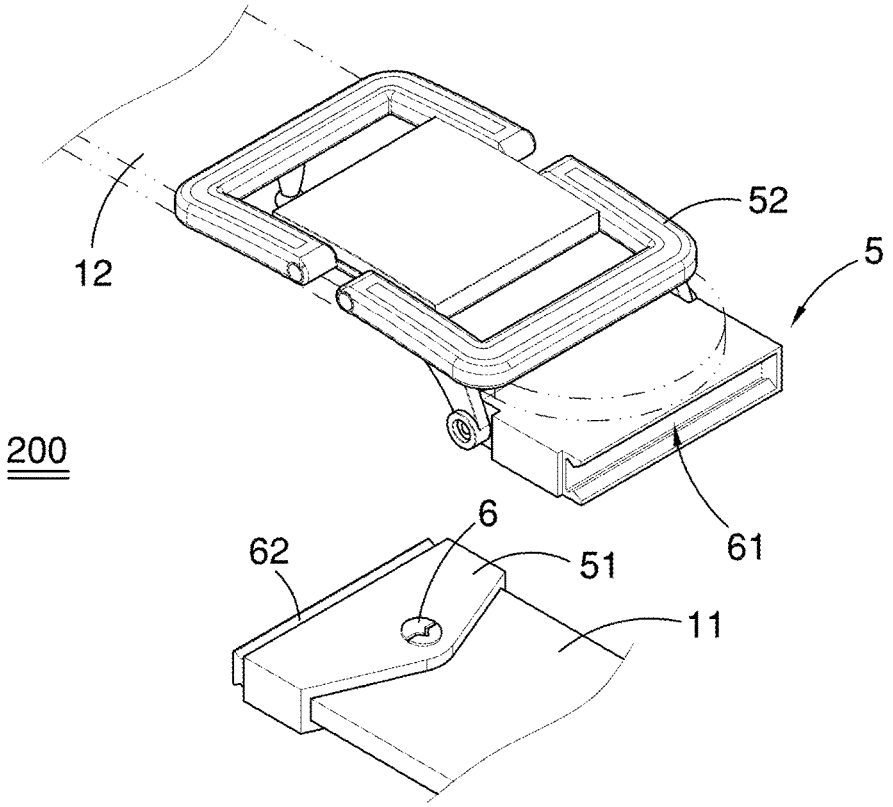
FIG. 7 is an exploded view of the quick release buckle belt in FIG. 6.
Figure 8:
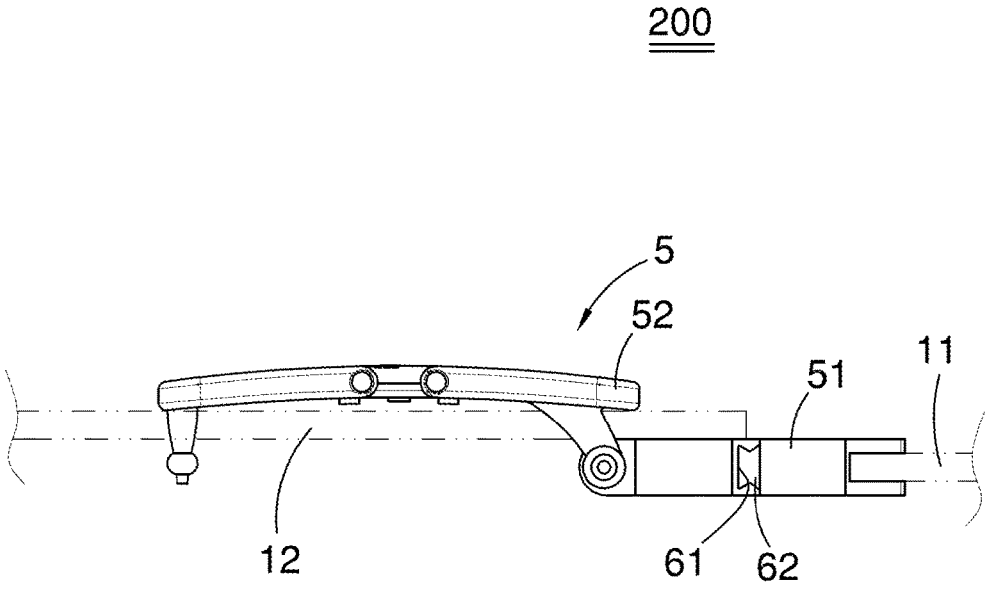
FIG. 8 is a cross-sectional view of the quick release buckle belt in FIG. 6, which shows the belt is in an engagement state.

FIG. 6 to FIG. 8 are perspective drawings showing a quick release buckle belt 200 for improving efficiency in an airport security screening procedure in accordance with a second embodiment of the present invention. Similar to the first embodiment, the quick release buckle belt 200 essentially comprises a strap 1 and a buckle 2 as well.

First of all, with reference to FIG. 6 and FIG. 7, the strap 1 includes a first end 11 and a second end 12 that are opposite to each other. The buckle 5 includes a connecting piece 51 and a buckle body 52. The connecting piece 51 is firmly secured to the first end 11 of the strap 1. Correspondingly, one end of the buckle body 52 is applied to fasten or unfasten the second end 12 of the strap 1, and another end of the buckle body 52 is designed to quick-detachably assemble to the connecting piece 51 as shown in FIG. 6 and FIG. 7. More specifically, the connecting piece 21 is substantially made of non-metallic materials. The buckle body 52 is made of metallic materials that can be detected by the metal detectors of airport security. Therefore, for those who wear such quick release buckle belt, all he/she needs to do before walking through the metal detector is to remove the metallic buckle body 52, without taking off the strap 1 and the non-metallic connecting piece 51 around the waist (assuming no other metallic accessories are worn thereon). Preferably, the quick release buckle belt 200 further comprises an identification mark 6 on the buckle body 52 or on the connecting piece 51, which represents that the connecting piece 51 of the quick release buckle belt 200 is substantially made of non-metallic materials. This shows that the connecting piece 51 is a permitted item that is allowed to pass through the metal detector. As such, it is convenient for consumers or the security personnel to identify such quick release buckle belt 200, which is distinct from other traditional belts.

In the second embodiment, the buckle 5 of the quick release buckle belt 200 further includes a dovetail groove 61 and a dovetail joint 62 in mating engagement with the dovetail groove 61, as shown in FIG. 7. The dovetail groove 61 and the dovetail joint 62 are disposed in transverse arrangement of the buckle 5, which allows the connecting piece 51 to be quickly attached to or quickly detached from the buckle body 52. The aforementioned dovetail groove 61 and the dovetail joint 62 are respectively disposed at the buckle body 52 and the connecting piece 51. Alternatively, dovetail groove 61 and the dovetail joint 62 are respectively disposed at the connecting piece 51 and the buckle body 52. In this embodiment, the dovetail groove 61 is defined in the buckle body 52 in transverse arrangement of the buckle 5, and the dovetail joint 62 is disposed in the connecting piece 51 in transverse arrangement of the buckle 5. As such, the dovetail groove 61 is capable of being fastened to the dovetail joint 62 (as shown in FIG. 6 or FIG. 8), or being released from the dovetail joint 62 (as shown in FIG. 7), permitting the connecting piece 51 and the buckle body 52 being quickly attached to or release from each other.

From another point of view, the present invention is directed to a method of improving efficiency in an airport security screening procedure for a user who wears a belt, which comprises the following steps. First of all, the aforementioned quick release buckle belt 100/200 is provided or made. Then, the user is informed by marketing or catalogues that for those who wears such quick release buckle belt 100/200, the only thing he/she needs to remove before walking through the metal detector is the buckle body 22/52, without taking off the strap 1 and the connecting piece 21/51 around user's waist. It is believed that the strap 1 and the connecting piece 21/51 secured thereto around user's waist are perfectly acceptable for the metal detector at security checkpoint. To put it another way, the security personnel is informed by manufacturers (or users) that the identification mark 6 on the quick release buckle belt 100/200 describes that the connecting piece 21/51 of the quick release buckle belt 100/200 is substantially made of non-metallic materials, which is a permitted item that is allowed to pass through the metal detector. Thus, in practical uses, the only part of the quick release buckle belt 100/200 user needs to remove is the buckle body 22/52. It is to be appreciated that when a user who wears the quick release buckle belt 100/200 having the identification mark 6 thereon arrives at security checkpoint, the security personnel identify the identification mark 6 on the quick release buckle belt 100/200 around user's waist. It is accordingly acceptable to wear the belt, including strap 1 and connecting piece 21/51 secured thereto, walking through the metal detector. Finally, with security personnel's permission, the user removes the buckle body 22/52 from the belt 100/200, and wears the strap 1 and connecting piece 21/51 secured thereto, walking through the metal detector.

It will be appreciated that although a particular embodiment of the invention has been shown and described, modifications may be made. It is intended in the claims to cover such modifications which come within the spirit and scope of the invention.

The invention claimed is:

1. A quick release buckle belt comprising a buckle and a strap having opposite first and second ends, the buckle comprising: a connecting piece, firmly secured to the first end of the strap, a buckle body having one end configured to selectively fasten or unfasten the second end of the strap, and the other end configured to quickly attach to or detach from the connecting piece; a guiding block formed at a central area of an end face of the connecting piece; a limiting slot defined in a central area of an end face of the buckle body to receive the guiding block when the buckle body is engaged with the connecting piece, thereby preventing lateral movement of the connecting piece with respect to the buckle body; an engaging recess including a front opening defined in the end face of the connecting piece, a side opening defined in a side of the connecting piece and adjacent to the front opening, an alcove with an opening facing the side opening of the engaging recess, and a guiding slope facing the front opening of the engaging recess; and an elastic fastener disposed in a side of the buckle body corresponding to the side of the connecting piece, and having a first end pivotally connected to the side of the buckle body, and a second opposite end configured to move with the first end so as to engage in or withdraw out of the alcove of the engaging recess; wherein when the elastic fastener is fed to the engaging recess, the second opposite end of the elastic fastener is pushed outward by the guiding slope of the engaging recess and then released back to engage in the alcove of the engaging recess; wherein when the second opposite end of the elastic fastener is engaged in the alcove of the engaging recess, the second opposite end of the elastic fastener is flush with the side of the connecting piece.

2. The quick release buckle belt as recited in claim 1, wherein the connecting piece is substantially made of non-metal that is acceptable for a walk-through metal detector at a security checkpoint; and the buckle body has a material of metal that is unacceptable for the metal detector at the security checkpoint.

* * * * *